US007472758B1

(12) United States Patent
Stevens et al.

(10) Patent No.: US 7,472,758 B1
(45) Date of Patent: Jan. 6, 2009

(54) INITIATOR FOR STOVETOP FIRE EXTINGUISHER

(75) Inventors: Michael R. Stevens, Midlothian, TX (US); Preston N. Weintraub, Saginaw, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 431 days.

(21) Appl. No.: 11/178,742

(22) Filed: Jul. 11, 2005

(51) Int. Cl.
*A62C 2/00* (2006.01)

(52) U.S. Cl. ..... 169/43; 169/59; 169/65; 169/28; 169/DIG. 3; 102/322; 102/323

(58) Field of Classification Search ..... 169/28, 169/59, 65, DIG. 3, 43; 102/335, 322, 323, 102/324
See application file for complete search history.

(56) References Cited

U.S. PATENT DOCUMENTS 100,884 A * 3/1870 Gomez ..... 102/275.1
2,417,082 A 3/1947 Mapes et al.
3,552,495 A 1/1971 Fiero
3,833,063 A 9/1974 Williams
3,874,458 A 4/1975 Williams
3,884,306 A 5/1975 Williams
3,884,307 A 5/1975 Williams
3,897,828 A 8/1975 Glover
4,023,494 A * 5/1977 Barton et al. ..... 102/314
4,485,741 A * 12/1984 Moore et al. ..... 102/331
4,813,487 A 3/1989 Mikulee et al.
5,375,523 A * 12/1994 Morris ..... 102/202.9
5,518,075 A 5/1996 Williams
5,881,819 A 3/1999 Walters et al.

* cited by examiner

*Primary Examiner*—Dinh Q Nguyen
(74) *Attorney, Agent, or Firm*—Morani Patent Law, P.C.; Amelia F. Morani

(57) ABSTRACT

A fire extinguisher has a container filled with a fire extinguisher material. One wall of the container has tear-open segments that breach the container when opened and allow the fire extinguisher material to exit the container. An initiator forces open the tear-open segments. The initiator has a cup that is coupled to the container wall. The cup contains combustible material and is closed by a cap. The cap is bonded to the cup to form a strong initiator housing. A fuse exits the initiator to the outside of the container wall.

15 Claims, 4 Drawing Sheets

INITIATOR FOR STOVETOP FIRE EXTINGUISHER

FIELD OF THE INVENTION

The present invention relates to apparatuses and methods for automatically initiating in the presence of a fire and disbursing an extinguishing agent.

BACKGROUND OF THE INVENTION

U.S. Pat. No. 5,518,075 discloses a fire extinguisher that is particularly well suited to a stovetop environment.

In a kitchen, grease fires and other types of fires are a concern. For example, a pan of grease on a stove burner can become so hot that it ignites. A grease fire left unextinguished can burn the walls around and above the stove.

The '075 patent provides a container of an extinguishing agent. The container is located above the stovetop, such as with a magnet secured to a hood over the stove. The bottom of the container contains a fuse. A fire on the stovetop ignites the fuse, which in turn detonates an initiator. The initiator opens the bottom of the container, thereby allowing the disbursement of the extinguishing agent onto the fire and the stovetop.

Several improvements have been made to the initiator of the '075 patent in the present invention. These improvements make the initiator, and thus the fire extinguisher, less expensive to manufacture. The improvements increase the reliability of the extinguisher and use a combustible material that is safer to handle.

SUMMARY OF THE INVENTION

The present invention provides a fire extinguisher, comprising a container forming a closed cavity, with the cavity having a wall. A fire extinguishing powder is located in the cavity. An initiator is provided for breaching the container wall and allowing the fire extinguishing powder to escape the container. The initiator comprises a cup and a cap. The cup has a base wall that is coupled to the container wall. The cap is bonded to the cup. The cup forms a volume that contains a combustible material. A fuse extends from the cup to an exterior of the container wall.

In accordance with one aspect of the present invention, the combustible material comprises black powder substitute.

In accordance with another aspect of the present invention, the cap is sonically welded to the cup.

In accordance with another aspect of the present invention, the combustible material contacts the cup base wall.

In accordance with still another aspect of the present invention, the container wall is a bottom wall, with the wall having at least one tear-open segment located in proximity to the initiator.

In accordance with still another aspect of the present invention, the initiator base wall is riveted to the container wall.

In accordance with still another aspect of the present invention, the cup base wall is weaker than the remaining portions of the cap and cup.

The present invention provides a method of assembling a fire extinguisher having a container with a wall, the wall structured and arranged to be breached. An initiator cup is coupled to the container wall. Combustible material is located in the cup. Then, the cup is closed with the cap and the cap is joined to the cup. Fire extinguishing powder is added to the container and the container is closed by coupling the wall to the container.

In accordance with one aspect of the present invention, the step of coupling an initiator cup to the container wall further comprises riveting the initiator cup to the container wall.

In accordance with another aspect of the present invention, the step of locating a combustible material in the cup further comprising locating black powder substitute in the cup.

In accordance with another aspect of the present invention, the step of joining the cap to the cup further comprises sonic welding the cap to the cup.

DESCRIPTION OF THE PREFERRED EMBODIMENT

In the description that follows, terms such as "top" and "bottom" are used. These terms refer to the use of the fire extinguisher in an orientation that is above the stove and is positioned so as to utilize gravity to disburse the fire extinguishing agent down to the top of the stove. The top of the stove (not shown) has one or more burners or heating elements. A pot or pan is placed upon a burner for cooking.

Figure 1:
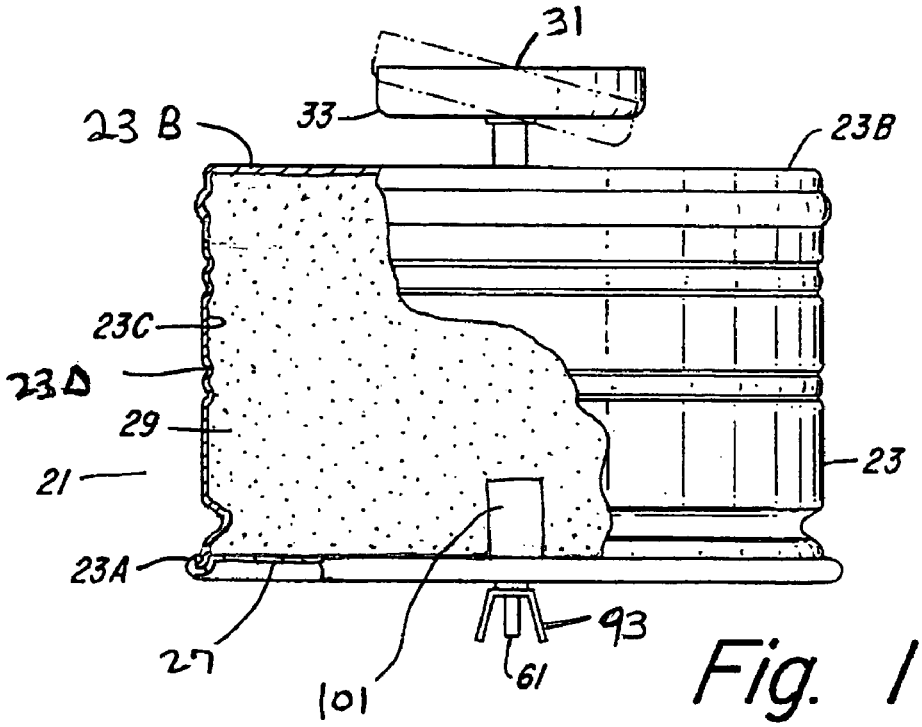
FIG. 1 is a partial cross-sectional view of the fire extinguisher of the present invention, in accordance with a preferred embodiment.
Figure 2:
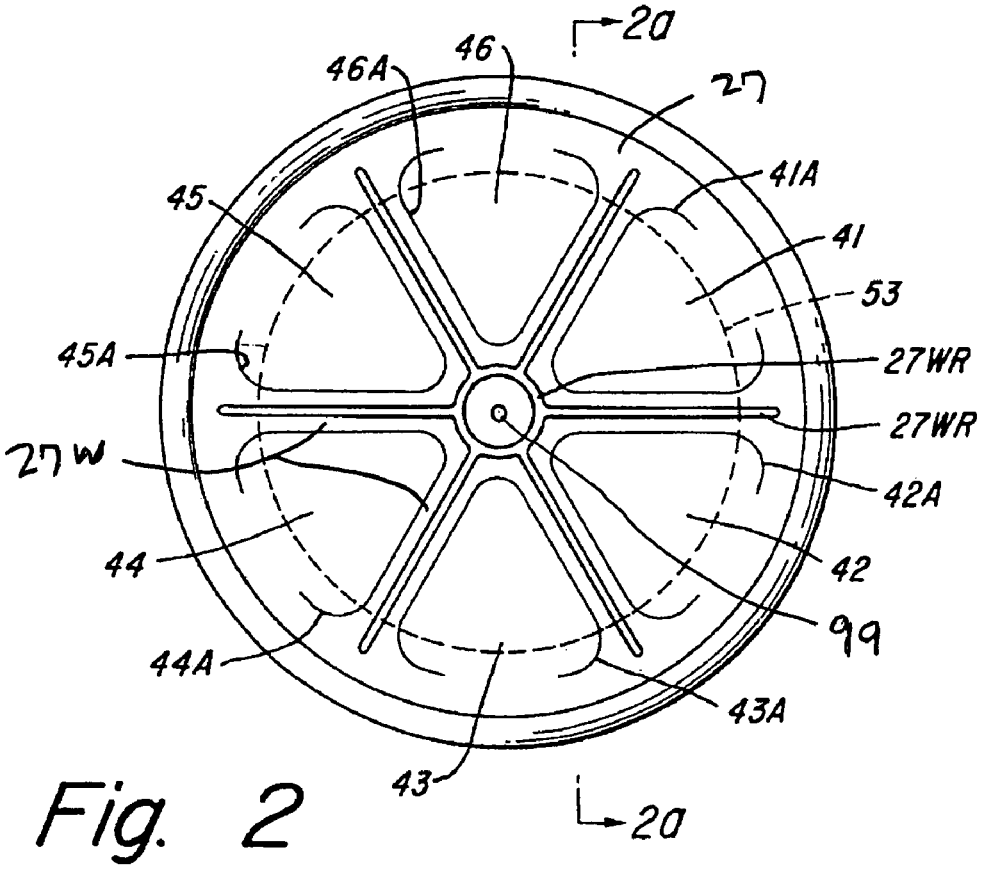
FIG. 2 is a plan view of the outside of the bottom wall of the fire extinguisher container.

Referring now to FIGS. 1 and 2, the fire extinguisher 21 comprises a metal container 23 or can formed by a cup shaped member. The container 23 has a top wall 23B, a cylindrical side wall 23D depending from the top wall and an open bottom that receives a lower lid 27. The container 23 can be noncylindrical. A cavity 23C is formed inside of the container. At the bottom of the side wall 23D is a lower end 23A which has a lip extending radially out. The lower lid 27 forms a bottom wall to the cavity and is sealed to the lower end 23A of the container 23 by a seam.

Located within the container is a fire extinguisher substance 29, preferably a fire extinguisher powder which may be of the ABC type or the BC type. As is well known, the ABC type is formed by about 90% monoammonium phosphate with about 10% silicones and other material (silicia, ground mica) added to keep it free flowing and to protect it from moisture. The BC type is about 90-94% bicarbonate. The balance of the material is stearates or silicones or other materials added to keep it free flowing and to protect the sodium bicarbonate from moisture.

The top wall 23B of the container 23 has a magnet 31 attached thereto to allow the fire extinguisher to be attached to a metallic object and hang with its bottom lid 27 downward. The fire extinguisher can be attached to the top of a vent-a-hood of a stove. The magnet 31 is located in a case 33 which is pivotally attached to the container.

As shown in FIG. 2, the bottom lid 27 has grooves or scored lines 41A-46A selectively formed on the outside thereof to facilitate breaking or rupturing of the bottom into separate tear-open segments 41-46 without fragmentation. The tear-open segments 41-46, when opened, form openings 41B-46B (see FIG. 3) in bottom lid 27. In the preferred embodiment shown in FIGS. 2 and 3, the free ends of the segments 41-46 are forced outward. This allows the fire extinguishing powder 29 to fall or pass outward from the container onto the fire below. Although the scoring is illustrated on the outside surface of the lid, it can be on the inside surface thereof.

The bottom lid 27 has webs 27W which extend around the openings 41B-46B. The bottom lid 27 also has embossed reinforcing ribs 27WR that are formed on the web 27W to make the web 27W stiffer and prevent the web from being pushed downward. This minimizes the problem of the segments or vanes not opening downward. The ribs 27WR are formed by bending the web 27W downward after the score lines 41A-46A are formed which tends to pull metal away from the score lines, thereby facilitating opening of the segments 41-46.

The fire extinguisher described so far is substantially the same as the fire extinguisher described in U.S. Pat. No. 5,518,075. What is different about the present invention is the initiator 101, or charge capsule, that opens the segments 41-46 in the bottom wall 27.

Figure 4:
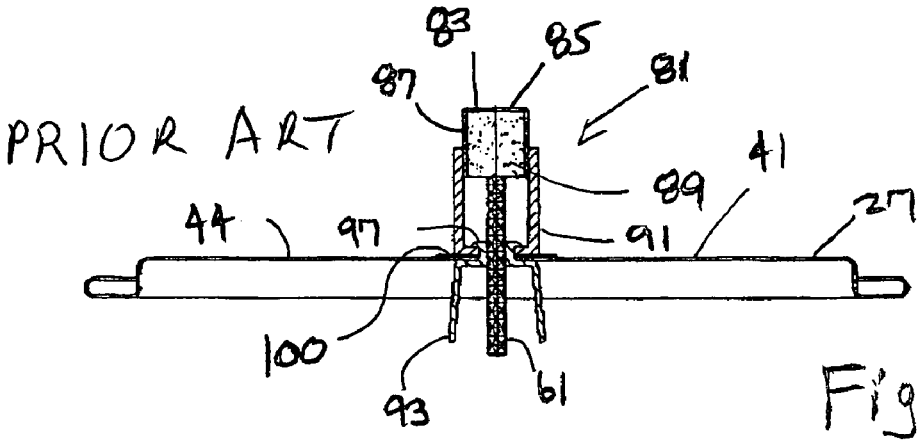
FIG. 4 is a cross-sectional view of the container bottom wall and the prior art initiator.

Before describing the initiator 101 of the present invention, the prior art initiator 81 will be described. Referring to FIG. 4, the prior art initiator 81 has a cap 83 with a top wall 85, a side wall 87 and an open bottom. The cap 83 contains a charge 89 of lead styphnate and glue. Lead styphnate is volatile, a high order explosive and highly regulated by the government. In addition, lead styphnate is toxic and requires special handling before being mixed with glue. The glue provides a bonding agent and retains the lead styphnate inside of the inverted cap 83. The cap 83 is press fit into a cylindrical cup 91, which cup is attached to the bottom lid 27 by a terminal 93. The terminal not only secures the cup to the bottom lid 27, but also provides protection for the fuse 61. The terminal 93 forms a rivet 97 at one end.

Figure 3:
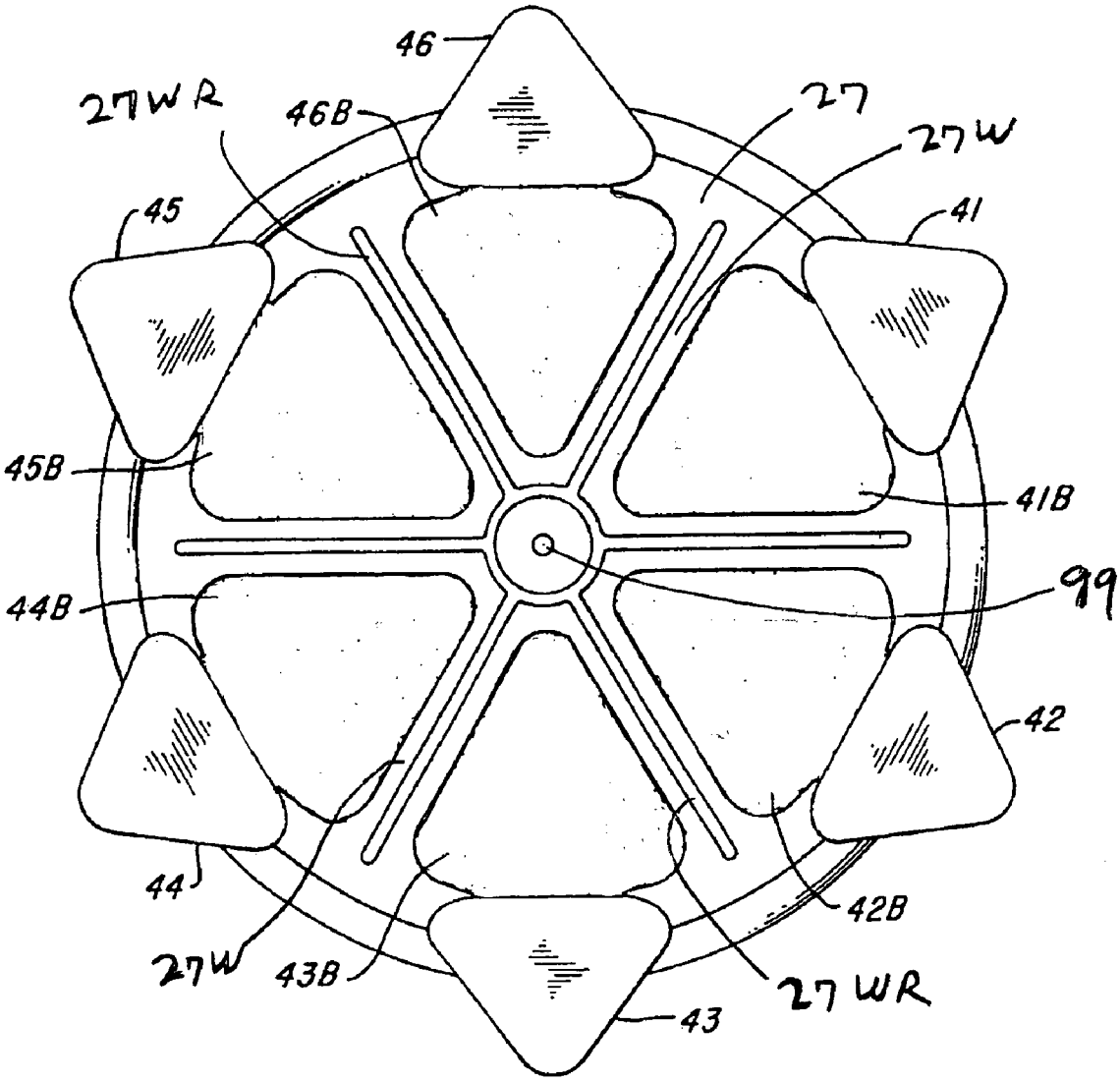
FIG. 3 is a plan view of the outside of the bottom wall of the fire extinguisher container after the tear-open segments have been opened by the initiator.

To assemble the prior art initiator 81 to the bottom lid 27, the rivet end 97 of the terminal 93 is inserted into a central hole 99 in the lid (see FIGS. 2 and 3; the terminal and fuse are not shown in FIGS. 2 and 3). The terminal 93 is on the outside of the lid 27. The cup 91 is located around the rivet end, on the inside of the lid 27. A felt washer 100 is interposed between the cup and the lid. The terminal 93 is then riveted in place; the cup 91 is secured to the lid by the terminal rivet 97. The cap 83 is inverted so that its open end is pointed down. The cap 83 is then press fit into the cup 91. The terminal 93 has an opening; a fuse 61 is press fit into the opening and a drop of lacquer is applied to the fuse to secure it in place to the lid and to provide a seal. The fuse extends into the cup until it contacts the cap 83. The charge 89 is separated from the lid 27 by a distance or gap.

The coupling between the lid 27 and the cup 91 must be strong to maintain the combustible charge 89 near the tear out segments 41-46. The riveting operation provides a strong coupling. However, the riveting of the terminal 93 and the cup 91 to the lid 27 is a high energy step. The combustible charge 89 must be added to the lid 27 after the riveting, in order to prevent accidental ignition. Therefore, the cap 83, with the combustible charge 89, is loaded after the riveting step.

Figure 5:
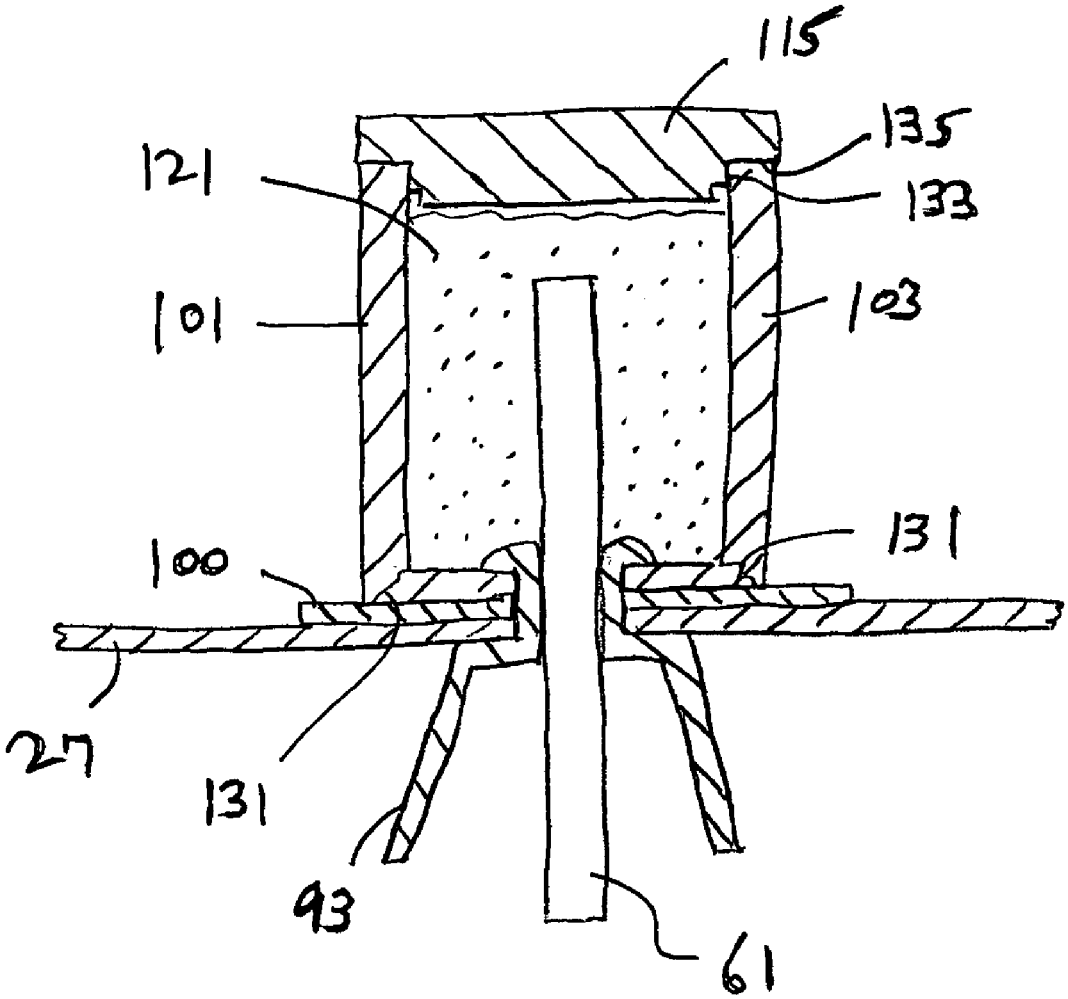
FIG. 5 is a cross-sectional view of the container bottom wall and the initiator of the present invention.
Figure 6:
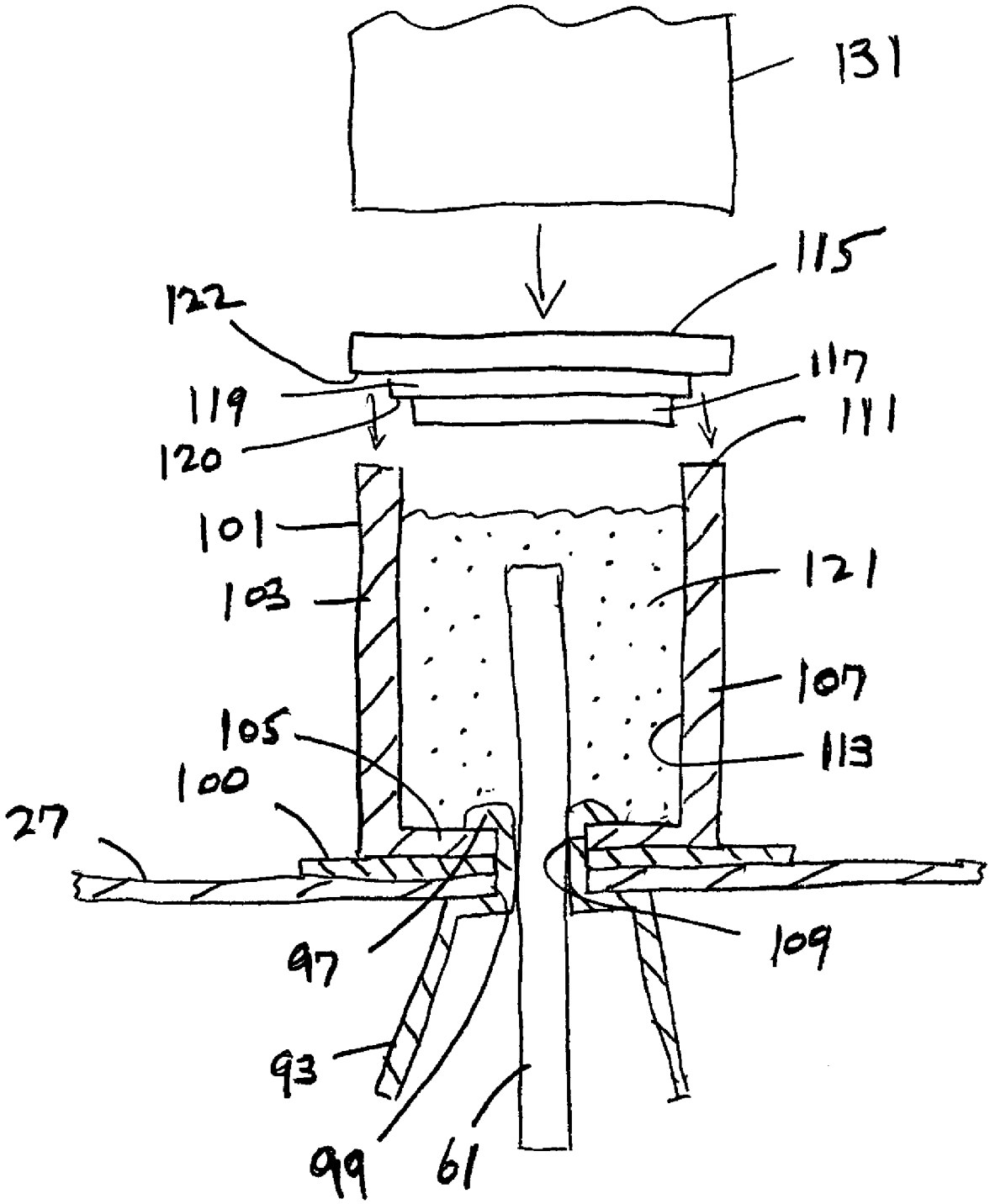
FIG. 6 is a cross-sectional exploded view of the unassembled initiator.

The initiator 101 of the present invention will now be described, with reference to FIGS. 5 and 6.

The initiator has a cup 103, which cup has a bottom, or base, wall 105 and a side wall 107. The side wall 107 is cylindrical in the preferred embodiment, although the shape of the initiator can be noncylindrical. The bottom wall 105 has a central opening 109 that receives the terminal rivet 97 and the fuse 61. The top end 111 of the side wall 107 preferably has sharp corners on the inside and outside diameters. A chamber 113 is formed inside of the cup 103.

The initiator also has a cap 115, which forms a top wall over the cup chamber 113. The cap 115 is designed to be sonically welded to the cup side wall 107. The inside of the cap has steps that form stop shoulders. The cap is the same shape as the cup. The lowermost, or first, step 117 is sized so as to form a slip fit for guidance and alignment with the inside diameter of the cup 103 side wall 107. The second step 119 is sized so as to be larger than the inside diameter of the cup side wall 107. The second step 119 forms a stop surface 120 that contacts the top end 111 of the cup side wall 107. Another stop surface 122 is formed radially of the second step 119. The overall diameter of the cap 115 is the same as the outside diameter of the cup side wall 107.

The cup receives a quantity of combustible material 121. In the preferred embodiment, this material is black powder substitute. Black powder substitute is relatively inexpensive, is readily available, low in volatility, is not classified as an explosive and has little or no government regulations. In addition, black powder substitute lacks the toxicity of lead styphnate. Consequently, precautions against toxic substances need not be taken with black powder substitute. Alternatively, gunpowder or smokeless powder could be used instead of black powder substitute. "Black powder substitute" as used herein includes gunpowder and smokeless powder.

When the cup 103 is closed with the cap 115, a closed chamber 113 is formed with the combustible material 121 located inside and attached to the lid 27.

The cup 103 is formed with differential wall thicknesses. The side wall 107 is thicker than the bottom wall 105. In addition, the cap 115 is thicker than the cup bottom wall 105. Thus, the closed chamber is designed so that the bottom wall 105 will fail at 131 before the side wall and the cap fail. The bottom wall is closest to the tear-open segments 41-46.

The assembly of the initiator 101 will now be described. The cup 103 is positioned on the inside of the lid 27 so that the cup bottom wall opening 109 aligns with the lid central opening 99. A felt washer 100 is located between the cup and the lid. The rivet end 97 of the terminal 93 is inserted from the outside of the lid through the lid central opening 99 and the cup opening 109. The terminal is riveted in place, thus coupling the cup 103 and the terminal 93 to the lid 27. The riveting operation occurs when there is no combustible material inside of the cup, thereby assuring against accidental combustion. Other types of coupling can be used. Next, a fuse 61 is press fit into the terminal opening so as to extend into the cup 103 and depend below the lid 27. A drop of lacquer at the terminal opening serves to secure the fuse in place and provides a seal. Next the cup is loaded with a predetermined quantity of combustible material 121. The combustible material could be loaded into the cup before the fuse is inserted. However, when using black powder substitute, the black powder substitute is loose and unconsolidated and can leak through the opening 99. Installing the fuse closes the opening 99.

Then, the cap 115 is pressed into the cup 103, with the cap first step 117 being located inside of the cup and the second step 119 contacting the top end 111 of the cup side wall 107. The cup and cap are made of a thermoplastic material, such 10% glass filled polyamide nylon 66. The assembly is located under a sonic welder, such that a welding head 131 or horn comes in contact with the cap 115. The welding head 131 causes the outer portion of the second step 119 to liquefy. The welding head 131 exerts pressure on the cap 115, forcing the cap further into the cup, wherein the second stop surface 122 now contacts the cup side wall 107. The welding head 131 is removed.

When the plastic coupling sets, the cup and cap assembly now form an integral container for the combustible material 121. The coupling between the cap 115 and the cup 103 is strong, using axial coupling 133 (shear weld) between the cup side wall inside diameter and the cap and also radial coupling 135 (transverse weld) between the top end of the cup side wall 111 and the cap.

The coupling or bonding of the cap to the cup can occur in other ways, for example, by a strong adhesive. The coupling step must not ignite the combustible material. With the present invention, no ignition occurs because the cap contains no combustible material, because there is a separation between the welds and the combustible material 121 and because the heat generated by the sonic welding is localized to the welds.

The lid 27 is now ready for assembly onto the container 23. This involves filling the container 23 with the fire extinguishing powder 29 (the container open end faces up). The lid 27 is then placed over the open end 23A of the container and the outer edge of the lid is crimped in place around the lower end of the side wall so as to form a sealed container.

In operation, when the fuse 61 ignites, the combustible material 121 also ignites. The combustible material 121 is in contact with or at least adjacent to the bottom wall 105. The bottom wall 105, which is weaker than the side wall and the bonded cap, fails at 131. The cap and the cup assembly direct the combustion gases downward and slightly out radially. This blows the segments 41-46 in the lid 27 open, thereby allowing the release of the extinguishing agent.

The initiator is highly reliable, as the cap does not separate from the cup and the combustible material 121 is located close to the tear-open segments 41-46. The explosion is directed towards the petals 41-46 by opening at 131.

The foregoing disclosure and showings made in the drawings are merely illustrative of the principles of this invention and are not to be interpreted in a limiting sense.

The invention claimed is:

1. A fire extinguisher, comprising:

a) a container forming a closed cavity, the container having a wall;

b) a fire extinguishing powder located in the cavity;

c) an initiator for breaching the container wall and allowing the fire extinguishing powder to escape the container;

d) the initiator comprising a cup and a cap, the cup having a base wall that is integral to sidewalls of the initiator cup, and the integral base wall of the cup is coupled to the container wall, wherein a washer is interposed between the base wall of the cup and the container wall, the cap being bonded to the cup;

e) the cup forming a volume that contains a combustible material adjacent to the base wall; and f) a fuse extends from the cup to an exterior of the container wall.

2. The fire extinguisher claim 1 wherein the combustible material comprises black powder substitute.

3. The fire extinguisher of claim 1 wherein the cap is sonically welded to the cup.

4. The fire extinguisher of claim 1 wherein the combustible material contacts the cup base wall.

5. The fire extinguisher of claim 1 wherein the container wall is a bottom wall, the bottom wall having at least one tear-open segment located in proximity to the initiator.

6. The fire extinguisher of claim 1 wherein the initiator bottom wall is riveted to the container wall.

7. The fire extinguisher of claim 1 wherein the cup base wall is weaker than the remaining portions of the cup and cap.

8. The fire extinguisher of claim 1, wherein:

a) the container wall is a bottom wall, the bottom wall having at least one tear-open segment located in proximity to the initiator;

b) the cup base wall is weaker than the remaining portions of the cup and cap;

c) the initiator base wall is riveted to the container wall;

d) the combustible material comprises black powder substitute; and e) the cap is sonically welded to the cup.

9. A method of assembling a fire extinguisher having a container with a wall, the wall structured and arranged to be breached, comprising the steps of:

a) coupling an initiator cup to the container wall, wherein an integral base wall of the initiator cup is parallel with the container wall, a washer is interposed between the base wall of the initiator cup and the container wall, and the integral base wall of the initiator cup is clamped to the container wall via respective parallel surfaces;

b) locating combustible material in the cup;

c) then closing the cup with a cap and joining the cap to the cup;

d) adding fire extinguishing powder to the container; and e) closing the container by coupling the container wall to sides of the container.

10. The method of claim 9 wherein the step of coupling an initiator cup to the container wall further comprises riveting the initiator cup to the container wall.

11. The method of claim 9 wherein the step of locating a combustible material in the cup further comprises the step of locating black powder substitute in the cup.

12. The method of claim 9 wherein the step of joining the cap to the cup further comprises sonic welding the cap to the cup.

13. The method of claim 9 wherein:

a) the step of coupling an initiator cup to the container wall further comprises riveting the initiator cup to the container wall;

b) the step of locating a combustible material in the cup further comprises the step of locating black powder substitute in the cup; and c) the step of joining the cap to the cup further comprises sonic welding the cap to the cup.

14. A fire extinguisher, comprising:

a container forming a closed cavity, the container having a wall;

a fire extinguishing powder located in the cavity;

an initiator for breaching the container wall and allowing the fires extinguishing powder to escape the container;

the initiator comprising a cup and a cap, the cup having a bottom wall that is integral to a cylinder sidewall of the cup, and is coupled to the container wall, wherein the cap has three stepped diameters, a first diameter narrower than an inner diameter of the initiator cup, a second diameter intermediate to the first diameter, and a third outermost diameter, which has a width near the outer diameter of the cup, and wherein the cap is bonded to the cup; and the cup forming a volume that contains a combustible material adjacent to the bottom wall; and a fuse extends from the cup to an exterior of the container wall.

15. The method of claim 13 wherein:

a) the step of joining the cap to the cup further comprising sonic welding, further comprises:

liquefying a portion of a second step of the cap, wherein the second step has an outer diameter equal to an intermediate cap diameter and has an inner diameter which is less than an inner diameter of the initiator cup, wherein the intermediate diameter is greater than an inner initiator cup diameter and less than an outer initiator cup diameter, and wherein a first step of the cap has a diameter equal to the inner diameter of the second step.

* * * * *